United States Patent [19]

Tsoukalas et al.

[11] 4,435,305

[45] Mar. 6, 1984

[54] CHEMICAL FORMULATION FOR RECLAIMING SILK SCREENS

[76] Inventors: Skevos N. Tsoukalas, 1426 Womack Rd., Dunwoody, Ga. 30338; John H. Andros, 3018-D Spring Hill Rd., Smyrna, Ga. 30080

[21] Appl. No.: 460,669

[22] Filed: Jan. 24, 1983

[51] Int. Cl.[3] ..... C11D 7/06

[52] U.S. Cl. ..... 252/158; 252/156; 252/162; 252/170; 252/364; 106/311; 101/129; 101/424

[58] Field of Search ..... 252/156, 158, 162, 170, 252/364; 106/311, 285; 101/129, 423, 424, 425

[56] References Cited

U.S. PATENT DOCUMENTS

| | | | |
|---|---|---|---|
| 3,031,409 | 4/1962 | Perlman et al. | 252/158 |
| 3,773,677 | 11/1973 | Boyles | 101/424 |
| 3,853,782 | 12/1974 | Change | 252/139 |
| 3,954,648 | 5/1976 | Belcak et al. | 252/158 |

FOREIGN PATENT DOCUMENTS

| | | |
|---|---|---|
| 2728276 | 1/1978 | Fed. Rep. of Germany . |
| 53-2102 | 1/1978 | Japan . |
| 54-5321 | 3/1979 | Japan . |
| 54-112905 | 9/1979 | Japan . |

*Primary Examiner*—John E. Kittle
*Assistant Examiner*—Hoa Van Le

[57] ABSTRACT

A non-aqueous liquid chemical formulation for reclaiming silk screens by removing simultaneously the stencil emulsion and ink is described. The silk screen is contacted with the liquid for a period sufficient to loosen the hardened stencil emulsion and the ink from the surface of the silk screen. The non-aqueous liquid chemical formulation is typically placed in a carbon steel tank at ambient temperature and the silk screen is immersed in the liquid for approximately five minutes. Alternately, the silk screen can be sprayed with the liquid formulation and allowed to soak for approximately seven minutes. The softened ink and stencil emulsion are then removed by using a high pressure water jet stream. The formulation contains an alkali metal hydroxide, a monohydric or polyhydric alcohol, a glycol ether, a surfactant, aliphatic and/or aromatic hydrocarbons and a wax.

9 Claims, No Drawings

CHEMICAL FORMULATION FOR RECLAIMING SILK SCREENS

BACKGROUND OF THE INVENTION

Silk screens are widely used by the printing industry throughout the world. They are constructed by stretching a fine weave material such as nylon or polyester around a wooden or metallic frame.

The silk screen is first coated with an emulsion of polyvinyl alcohol-polyvinyl acetate which also contains photosensitive catalysts such as diazo compounds, cupric dichromate, chromic nitrate or sodium bichromate. The image of the design to be printed is transferred on the silk screen by the following method. A negative of the image is prepared on regular photographic film and is placed on the coated and air-dried silk screen. The silk screen is then exposed to intense light to activate the catalysts. The emulsion on the areas of the silk screen not covered by the image becomes hard, impervious to water, solvents or ink and can no longer be removed with water. The areas of the emulsion covered by the image are protected from the intense light, do not harden and can be removed by a high pressure water jet stream. The result is a finished silk screen which is covered entirely by the hardened emulsion except for the area which was covered by the image.

In order to transfer the image from the silk screen to the desired substrate, ink is applied on one side of the silk screen. The screen is laid on the surface to be printed and the ink is smeared under pressure with a squeegee. The silk screen is then lifted leaving behind the image on the substrate.

Once a certain job is completed and the used silk screen no longer needed, it is desirable to reclaim the silk by removing completely the hardened stencil emulsion and the ink. The different chemical natures of the ink and the stencil emulsion make it extremely difficult to effectively remove both items with one chemical formulation. Inks, for example, can be removed with aromatic and aliphatic hydrocarbons, with chlorinated hydrocarbons and with ketones. These solvents, however, do not remove the hardened polyvinyl alcohol-polyvinyl acetate emulsion. On the other hand, chemicals such as alkali metal hydroxide solutions and bleach which soften the hardened stencil emulsion do not remove the ink. These chemicals are not compatible or soluble in the ink solvents and cannot be combined with them into one formulation.

Traditionally, silk screens are reclaimed by removing the ink with an organic solvent. The hardened emulsion is removed with a bleach or an aqueous caustic solution in a separate step. This is a time consuming and undesirable method.

The Fremont Industries (U.S. Pat. No. 3,853,782) silk screen cleaner utilizes an aqueous solution of alkalies and surfactants capable of softening the hardened stencil emulsion and the ink simultaneously. This process, however, has some very serious dissadvantages. They are as follows:

1. This solution must be heated and maintained at 180°–250° F. to be effective. This requires expensive heated tanks. Maintenance and energy costs for such a system can become undesirable to the user.

2. The silk screen must be immersed for a minimum of fifteen minutes in the heated solution to obtain satisfactory results.
3. This solution often leaves residual spots which must be removed with a strong solvent such as methyl ethyl ketone.
4. This solution often leaves ghost images.

The present invention relates to a non-aqueous liquid chemical formulation which is capable of softening and removing simultaneously both the hardened emulsion and the ink at ambient temperatures. This formulation makes it possible to reclaim the silk screen in approximately five to seven minutes, depending on the method of contact.

These and other objects, features and advantages of the present invention will become apparent from a review of the preferred embodiment of the invention and the appended claims.

SUMMARY OF THE INVENTION

It has now been found that silk screens may be quickly, easily and effectively reclaimed by contacting them for approximately five to seven minutes at ambient temperature with a non-aqueous liquid chemical formulation consisting essentially of isobutyl alcohol, potassium hydroxide, ethylene glycol, ethylene glycol monobutyl ether, mineral spirits, gum turpentine and alkyl phenoxy polyethoxy ethanol surfactant.

This non-aqueous liquid chemical formulation loosens the hardened stencil emulsion and the ink simultaneously from the silk screen. Subsequently, the loosened material is removed from the surface of the silk screen with a high pressure water jet stream.

Accordingly, it is an object of the present invention to provide an improved liquid chemical formulation for quick reclamining of silk screens.

A further object of the present invention is to provide a liquid chemical formulation for reclaiming silk screens which uses a non-aqueous chemical composition to loosen the ink and the hardened stencil emulsion from the surface of the silk screen.

Another object of the present invention is to provide a liquid chemical formulation for reclaiming silk screens which does not require the application of heat.

Another object of the present invention is to provide a liquid chemical formulation for reclaiming silk screens that have not been used for a long period of time and the ink has dried.

Another object of the present invention is to provide a liquid chemical formulation for reclaiming silk screens which have been coated with very hard emulsions and a variety of inks.

Another object of the present invention is to provide an alkaline non-aqueous solution for removal of the hardened emulsion and ink from the surface of silk screens whose activity can be maintained by replenishing the solution with a concentrate.

Other and further objects of the present invention will become apparent upon a study of the following preferred embodiment of the invention and the appended claims.

DETAILED DESCRIPTION OF THE PREFERRED EMBODIMENT

The chemical composition of the present invention for simultaneously removing the hardened stencil emulsion and ink from silk screen surfaces at ambient temperatures without an adverse effect on the materials of the silk screen is as follows:

| Component | % By Weight |
|---|---|
| An alkali metal hydroxide or a tetraalkyl ammonium hydroxide such as potassium hydroxide | 2–10 |
| An alcohol containing $C_1$–$C_{12}$ carbon atoms such as isobutyl alcohol | 20–50 |
| A glycol containing $C_1$–$C_6$ carbon atoms such as ethylene glycol | 5–30 |
| A nonionic or anionic surfactant such as alkyl phenoxy polyethoxy ethanol or sodium lauryl sulfate | 2–10 |
| A glycol monoalkyl ether such as ethylene glycol monobutyl ether | 2–10 |
| A nonpolar hydrocarbon solvent composed of aliphatic, aromatic and/or turpene hydrocarbons such as toluene, xylene, mineral spirits and turpentine | 20–40 |
| Parafin wax or polyethylene glycol wax | 0.2–2 |

The primary function of the alkali metal hydroxide is to soften the polyvinyl alcohol-polyvinyl acetate emulsion. This is accomplished by depolymerization of the stencil and by removal of the acetate groups from the polyvinyl acetate molecules as shown by the following equation:

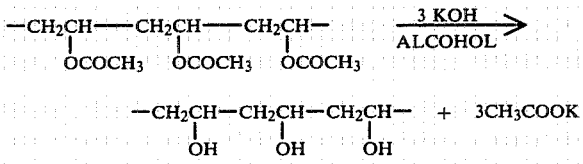

Thus, the less polar acetate groups are removed as potassium acetate and the number of polar hydroxyl groups is increased in the stencil material. The increased polarity makes the stencil material readily dispersible when sprayed with a very polar solvent such as water.

The potassium hydroxide will also have a softening effect on the binding resins of certain inks. Inks composed of materials containing esters of polyesters such as polyvinyl acetate, alkyd resins or other polyesters will be attacked by the alkali metal hydroxides. The esters will be hydrolized and the ink will be converted into a readily dispersible material.

The alkali metal hydroxides are predominantly ionic compounds and are soluble in polar solvents such as water and alcohols. The cleavage, however, of the ester groups takes place much faster in an alcholic solution (alcoholysis) than in an aqueous solution (hydrolysis). This is one reason for selecting alcohols over water in this formulation. Alcohols, on the other hand, are not as good solvents for alkali metal hydroxides with the least soluble being lithium hydroxide and the most soluble being potassium hydroxide. The addition of a more polar substance such as glycol into the formulation increases its ability to dissolve the alkali metal hydroxide and increase its concentration. Another advantage of using a glycol is the resulting increase in the flash point of the formulation and decrease of flammability.

The alcohols not only serve as solvents for the alkali metal hydroxides but also penetrate the inks and either help to dissolve or swell them making their removal easier. Alcohols, however, are not the optimum solvents for the inks. The inks are best removed with solvents such as ketones, chlorinated hydrocarbons or aromatic and aliphatic hydrocarbons. From these, the ketones and the chlorinated hydrocarbons are not compatible with the alkali metal hydroxide with which they react. The alkali metal hydroxides do not react with aromatic and aliphatic hydrocarbons but also they are not soluble in them.

This formulation brings together into one solution an alcoholic solution of an alkali metal hydroxide and a nonpolar hydrocarbon such as an aromatic, aliphatic or alicyclic hydrocarbon. To stabilize the formulation and prevent the separation of polar components such as alcohols, glycols and alkali metal hydroxides from the nonpolar hydrocarbons, a coupling agent such as a glycol monobutyl ether is added. These types of coupling agents are soluble in both polar and nonpolar liquids and help bring together two such immiscible liquids into one phase.

The role of the surfactant is to facilitate the impregnation of the stencil and ink and also their removal with water.

The role of the parafin or polyethylene glycol wax is to prevent the readherence of the stencil and the ink to the silk screen surface during the spraying with water.

The application of the above considerations is exemplified by the following formulations:

EXAMPLE FORMULATION I

| Component | % By Weight |
|---|---|
| Isopropyl Alcohol | 50 |
| Ethylene Glycol | 5 |
| Potassium Hydroxide | 5 |
| Toluene | 35 |
| Alkyl Phenoxy Polyethoxy Ethanol | 4 |
| Parafin Wax | 1 |
| | 100 |

This formulation is prepared by dissolving the potassium hydroxide into the mixture of isopropyl alcohol and ethylene glycol. Heating and stirring of the mixture increases the dissolution of the potassium hydroxide. The remaining components are added in the order listed above and under continuous stirring. This formulation is a clear liquid and can be used in a dip tank or as a spray.

The silk screen is first immersed in the tank for five minutes or it is sprayed and allowed to soak for seven minutes. Then it is cleaned with a high pressure water jet stream. The stencil and the ink are removed without leaving behind ghost images. After drying, the screen is ready for reuse.

Replacement of isopropyl alcohol with a higher alcohol, the addition of a higher percentage of glycol and the replacement of toluene with a hydrocarbon which has a higher flash point results in formulations much less flammable.

EXAMPLE FORMULATION II

| Component | % By Weight |
|---|---|
| Isobutyl Alcohol | 27 |
| Ethylene Glycol | 17 |
| Potassium Hydroxide | 5 |
| Alkyl Phenoxy Polyethoxy Ethanol | 6 |
| Gum Turpentine | 36 |
| Parafin Wax | 1 |
| Ethylene Glycol Monobutyl Ether | 8 |
| | 100 |

This formulation is prepared by dissolving the potassium hydroxide into the ethylene glycol. Heating and stirring of the mixture increases the dissolution of the potassium hydroxide. The remaining components are added in the order listed above and under continuous stirring. This formulation yields a clear brown liquid and can be used in a dip tank or as a spray. This formulation is as effective as Formulation I and gives excellent results even at subambient temperatures.

EXAMPLE FORMULATION III

| Component | % By Weight |
|---|---|
| Isobutyl Alcohol | 27 |
| Ethylene Glycol | 18 |
| Potassium Hydroxide | 5 |
| Alkyl Phenoxy Polyethoxy Ethanol | 6 |
| Ethylene Glycol Monobutyl Ether | 8 |
| Mineral Spirits | 35 |
| Parafin Wax | 1 |
| | 100 |

This formulation is prepared by dissolving the potassium hydroxide into the ethylene glycol. Heating and stirring of the mixture increases the dissolution of the potassium hydroxide. The remaining components are added in the order listed above and under continuous stirring. This formulation yields a clear light yellow liquid and can be used in a dip tank or as a spray. This formulation produces comparable results to Formulations I and II.

EXAMPLE FORMULATION IV

| Component | % By Weight |
|---|---|
| Isobutyl Alcohol | 27 |
| Ethylene Glycol | 17 |
| Potassium Hydroxide | 5 |
| Alkyl Phenoxy Polyethoxy Ethanol | 6 |
| Gum Turpentine | 16 |
| Mineral Spirits | 16 |
| Ethylene Glycol Monobutyl Ether | 12 |
| Parafin Wax | 1 |
| | 100 |

This formulation is prepared by dissolving the potassium hydroxide into the ethylene glycol. Heating and stirring of the mixture increases the dissolution of the potassium hydroxide. The remaining components are added in the order listed above and under continuous stirring. This formulation yields a clear light brown liquid and can be used in a dip tank or as a spray. This formulation performs superior to Formulations I, II and III. The combination of turpentine with mineral spirits increases the ability of the formulation to remove inks.

EXAMPLE FORMULATION V

| Component | % By Weight |
|---|---|
| Cyclohexanol | 25 |
| Ethylene Glycol | 18 |
| Potassium Hydroxide | 5 |
| Gum Turpentine | 18 |
| Mineral Spirits | 18 |
| Alkyl Phenoxy Polyethoxy Ethanol | 5 |
| Ethylene Glycol Monobutyl Ether | 10 |
| Parafin Wax | 1 |
| | 100 |

This formulation is prepared by dissolving the potassium hydroxide into the ethylene glycol. Heating and stirring of the mixture increases the dissolution of the postassium hydroxide. The remaining components are added in the order listed above and under continuous stirring. This formulation yields a clear light brown liquid and can be used in a dip tank or as a spray. This formulation is an excellent silk screen reclaiming solution and has a flash point above 100° F.

EXAMPLE FORMULATION VI

| Component | % By Weight |
|---|---|
| Isobutyl Alcohol | 27 |
| Ethylene Glycol | 16 |
| Potassium Hydroxide | 15 |
| Gum Turpentine | 15 |
| Mineral Spirits | 16 |
| Alkyl Phenoxy Polyethoxy Ethanol | 5 |
| Ethylene Glycol Monobutyl Ether | 5 |
| Parafin Wax | 1 |
| | 100 |

This formulation is prepared by dissolving the potassium hydroxide into the ethylene glycol. Heating and stirring of the mixture increases the dissolution of the potassium hydroxide. The remaining components are added in the order listed above and under continuous stirring. This formulation contains a higher percentage of potassium hydroxide and its intended use is to replenish the consumed liquid in the dip tank and bring the concentration of potassium hydroxide near the desired level of five percent by weight.

It should be understood, of course, that the foregoing relates to a preferred embodiment of the present invention and that numerous modifications or alterations may be made therein without departing from the spirit and scope of the invention as set forth in the appended claims.

What is claimed is:

1. A method for removing hardened stencil emulsion and ink from the surface of a silk screen comprising the steps of: contacting said silk screen at ambient temperatures for a period of time sufficient to loosen said stencil and ink from said silk screen surface with a solution of a non-aqueous formulation consisting essentially of approximately 20–60% by weight of a $C_1$–$C_{12}$ alcohol, 2–10% by weight of an alkali metal hydroxide and 20–60% by weight of a hydrocarbon solvent and separating said loosened stencil and ink from said silk screen surface by a high pressure water jet stream.

2. The method of claim 1 wherein the said alkali metal hydroxide is potassium hydroxide.

3. The method of claim 1 wherein the said alcohol is isobutyl alcohol.

4. The method of claim 1 wherein the said hydrocarbonds are mineral spirits and gum turpentine.

5. The method of claim 1 wherein the formulation consists essentially of:

| Component | % By Weight |
|---|---|
| Isobutyl Alcohol | 20–50 |
| Ethylene Glycol | 5–30 |
| Potassium Hydroxide | 2–10 |
| Alkyl Phenoxy Polyethoxy Ethanol | 2–10 |
| Mineral Spirits | 20–50 |
| Gum Turpentine | 20–50 |
| Parafin Wax | 0.5–2 |

-continued

| Component | % By Weight |
|---|---|
| Ethylene Glycol Monobutyl Ether | 2–10 |

6. The method of claim 1 wherein the formulation consists essentially of:

| Component | % By Weight |
|---|---|
| Isobutyl Alcohol | 27 |
| Ethylene Glycol | 17 |
| Potassium Hydroxide | 5 |
| Alkyl Phenoxy Polyethoxy Ethanol | 6 |
| Mineral Spirits | 20 |
| Gum Turpentine | 20 |
| Parafin Wax | 1 |
| Ethylene Glycol Monobutyl Ether | 4 |

-continued

| Component | % By Weight |
|---|---|
| | 100 |

7. The method of claim 1 carried out at ambient temperature without the application of heat.

8. The formulation of claim 1 wherein the composition is effectively removing the hardened stencil emulsion and ink simultaneously.

9. A non-aqueous formulation for removing hardened stencil emulsion and ink from the surface of a silk screen said formulation consisting essentially of: 2–10% of an alkali metal hydroxide, 20–50% of an alcohol containing 1–12 carbon atoms, 5–30% of a glycol containing 1–6 carbon atoms, 2–10% an anionic or nonionic surfactant, 2–10% of a glycol monoalkyl ether and 20–40% of a non-polar hydrocarbon solvent, said percentage being by weight.

* * * * *